US010167682B2

(12) United States Patent
Morrow

(10) Patent No.: US 10,167,682 B2
(45) Date of Patent: Jan. 1, 2019

(54) COUPLING MOUNTED SPIN-THROUGH ROD CENTRALIZER

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 481 days.

(21) Appl. No.: 14/879,148

(22) Filed: Oct. 9, 2015

(65) Prior Publication Data

US 2016/0177635 A1 Jun. 23, 2016

Related U.S. Application Data

(60) Provisional application No. 62/094,215, filed on Dec. 19, 2014.

(51) Int. Cl.
*E21B 17/10* (2006.01)
*E21B 17/042* (2006.01)
*E21B 17/043* (2006.01)

(52) U.S. Cl.
CPC ..... *E21B 17/1071* (2013.01); *E21B 17/042* (2013.01); *E21B 17/043* (2013.01)

(58) Field of Classification Search
CPC .. E21B 17/042; E21B 17/043; E21B 17/1071; E21B 17/10
See application file for complete search history.

(56) References Cited

U.S. PATENT DOCUMENTS

| | | | | | |
|---|---|---|---|---|---|
| 3,049,382 | A * | 8/1962 | Ell | E21B 17/1071 | 166/241.4 |
| 4,823,456 | A * | 4/1989 | Gray | B05D 1/24 | 166/106 |
| 4,905,760 | A * | 3/1990 | Gray | B05D 1/24 | 166/105 |
| 4,919,202 | A * | 4/1990 | Clintberg | E21B 17/1064 | 166/176 |
| 5,950,744 | A * | 9/1999 | Hughes | E21B 17/046 | 166/242.6 |
| 2008/0035329 | A1* | 2/2008 | Carstensen | E21B 17/0426 | 166/176 |
| 2012/0186818 | A1* | 7/2012 | Wollmann | E21B 17/042 | 166/301 |
| 2012/0193089 | A1* | 8/2012 | Makelki | E21B 17/1071 | 166/241.1 |

* cited by examiner

*Primary Examiner* — Caroline N Butcher
(74) *Attorney, Agent, or Firm* — The Roy Gross Law Firm, LLC; Roy Gross

(57) ABSTRACT

A spin-through rod centralizer consisting of a stator mounted on the rod coupling which provides the bearing surface for rotation of the coupling within the stator. The stator is restrained from such axial movement by two steel "washers" that are captured between the rod shoulders and the coupling when the connection between two rods is made up. The washers are slightly larger in diameter than the coupling and thereby keep the stator located on the coupling, yet do not restrict the relative rotation between the coupling and the stator. An alternative configuration uses a coupling with a shoulder at one end that acts as one of the "washers" to restrain the stator from axial movement.

2 Claims, 6 Drawing Sheets

COUPLING MOUNTED SPIN-THROUGH ROD CENTRALIZER

Applicant claims the benefits of provisional application Ser. No. 62/094,215, filed Dec. 19, 2014. The present invention relates to improvements in spin-through drive rod centralizers, and in particular spin-through centralizers mounted at the connection between adjacent rods, that are used to rotationally drive a downhole pump to retrieve and deliver to the surface production fluids from subterranean deposits.

FIELD OF INVENTION

Rod centralizers, of which spin-through centralizers are one type, are used principally to keep a rotating rod string from contacting the inner wall of the production tubing. In some rotating rod applications, such as geared centrifugal pump (GCP) applications, particularly where rod string tension is low, the centralizers are also used to maintain rotational stability. Unstable rotation is undesirable when the amplitude of the unstable motion is greater than the internal diameter of the tubing, causing rod-tubing contact. The unstable motion of the rod also increases the likelihood of fatigue failure of the rod string.

A rod rotating around its principal axis will turn smoothly up to a critical rotational speed, which is a function of the diameter of the rod, physical properties of the rod material, and the cross-sectional shape, the distance between supports or bearings, and the axial tension the rod is experiencing. During stable rotation, the natural stiffness of the rod is great enough to overcome the centrifugal force of the rotation. However, as the rotational speed increases, the centrifugal force increases with the square of the rotational speed, while the stiffness remains unchanged, and, eventually, the tendency of the rod to swing out of the stable, linear rotational axis will be greater than the stiffness can resist, and the rod will begin rotating unstably.

The effective stiffness of the rod can be increased by decreasing the unsupported length of rod, by installing bearings, or rotational supports, at closer spacing along the rod's length. This will increase the stable rotational speed. For rods, these supports, or bearings, can be simple centralizers, which are fixed to and rotate with the rod, or they can be spin-through type centralizers, which consist of a stator that stays rotationally fixed within the tubing, with the rod passing through a central bore of the stator, and rotating therein. The present invention disclosed and described herein is of the spin-through type.

There are two principal types of spin-through centralizers currently commercially available. The more common consists of a vaned plastic stator that is fitted over a thermoplastic sleeve molded on to the body of the rod. The advantage of this type of spin-through centralizer is that any number of them can be applied to the rod, as required by the rotational stability needs. In low-tension portions of the rod string in GCP applications, for instance, as many as four centralizers per 25' rod may be required.

The other type of spin-through centralizer is mounted only at the connection between rods. The type currently commercially available consists of a short, steel shaft that is threaded at both ends, with a section between the threaded portions that forms the journal, onto which the plastic stator is mounted. The threaded journal shaft is attached to the two adjacent rods via two standard female rod couplings. The outer diameter of the couplings is slightly larger than the outer diameter of the shaft journal surface, so the stator cannot move axially off the journal during rod rotation.

This connection mounted spin-through centralizer described above has several drawbacks, principal of which is cost. In addition, the extra length of the connection due to the threaded journal shaft requires that the rod connection so equipped must be made up by hand rather than via mechanical rod tongs, a time consuming process. Also, the connection itself is not as strong as a conventional connection due to the reduced shoulder area between the threaded journal shaft and the couplings.

The present invention is also a connection-mounted spin-through centralizer, but addresses all the shortcomings of the currently available type, by doing away with the threaded journal shaft and the additional coupling, allowing the rod connections to be made-up with existing equipment. The resulting connection of the present invention is also equal to the strength of a standard connection and, due to its simplicity, can be produced at significantly reduced cost compared to the currently available type.

SUMMARY OF INVENTION

Figure 1:
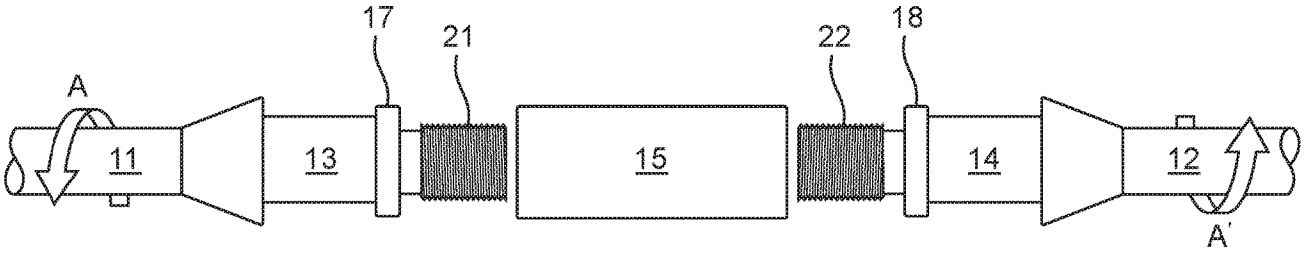
FIG. 1 shows a side view of a conventional rod connection prior to make-up.
Figure 2:
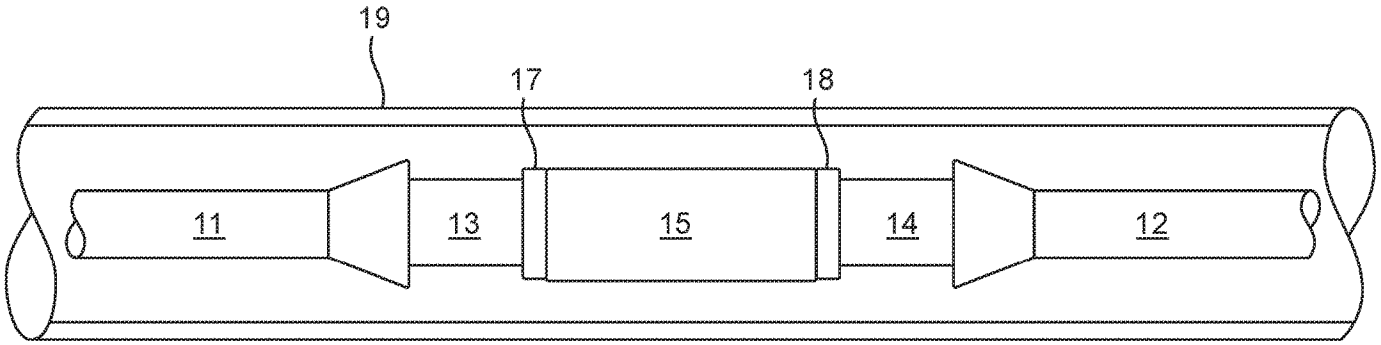
FIG. 2 shows a side view of a conventional made-up connection between adjacent rods, within the production tubing.

The utility, strength and low cost of the proposed spin-through centralizer of the present invention arises from the fact that it utilizes the components and function of a conventional rod connection. FIGS. 1 and 2 show the components and configuration of a conventional rod connection. FIG. 1 shows the adjacent ends of two rods 11 and 12 to be connected. At both ends of every rod, which are typically 25 feet in length, there is a male threaded pin, a shoulder against which the connection is made, and a wrench flat that allows gripping the rods for make-up of the threaded connections. These three components of rod 11 are threaded pin 21, shoulder 17, and wrench flat 13. Adjacent rod 12 is similarly equipped, with threaded pin 22, shoulder 18 and wrench flat 14. The outer surface of shoulders 17 and 18, which contact the ends of female threaded coupling (heretofore simply referred to as "coupling") 15 when the connection is made-up, are finely machined, as are the ends of the coupling. The two male threaded pins 21 and 22 are screwed into coupling 15, the rotational direction shown by arrows A and A', with the connection made up against shoulders 17 and 18, putting the male threaded pins 21 and 22 into tension, and joining the two rods 11 and 12, as shown in FIG. 2. Note the connected rods in FIG. 2 are shown within a length of production tubing 19.

Figure 3:
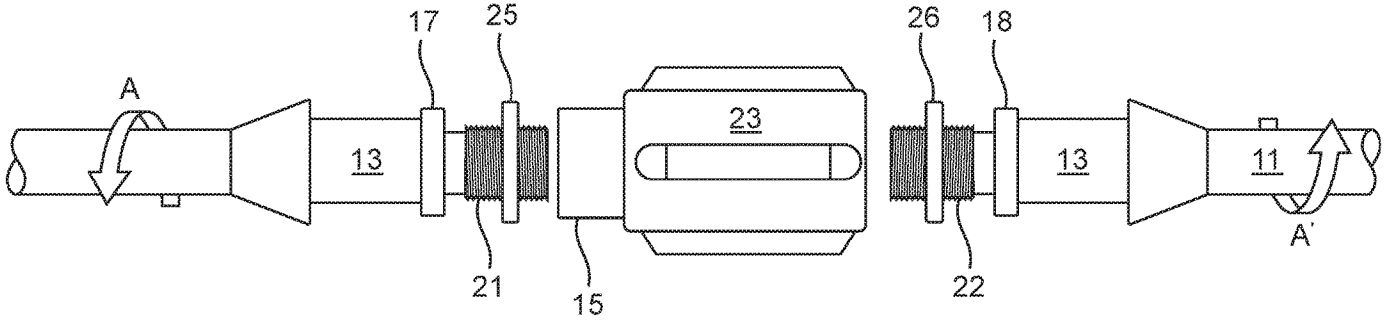
FIG. 3 shows the components of the first embodiment of the present invention, prior to rod connection make-up.
Figure 4:
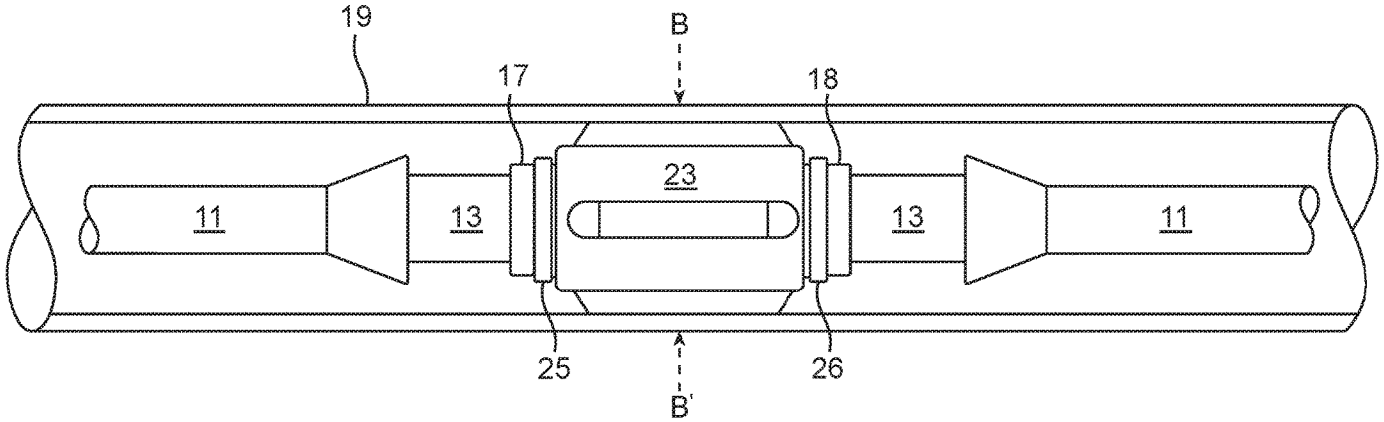
FIG. 4 shows a side view of the first embodiment of the present invention, with the connection made up, and within the production tubing.

FIG. 3 shows the components of the first of the preferred embodiments of the present invention during assembly and make-up. A stator 23 is fitted over the coupling 15 prior to make-up, and two washers, 25 and 26, are fitted over male threaded pins 21 and 22, respectively. The connection is made up as it is for a normal rod connection, with the male threaded pins 21 and 22 screwed into the coupling 15, but with the connection made up against the washers 25 and 26, as seen in FIG. 4. Washers 25 and 26 are fabricated from steel with characteristics similar to that of the rod 11 and 12 and coupling 15, and form the contact surfaces between the rod connection shoulders 17 and 18, and the coupling 15 when the connection is made up with the stator 23 axially captured between them. Note in FIG. 4 the small gap 28 between the stator 23 and the washer 25, which allows free rotation of the stator 23 relative to coupling 15.

Figure 7:
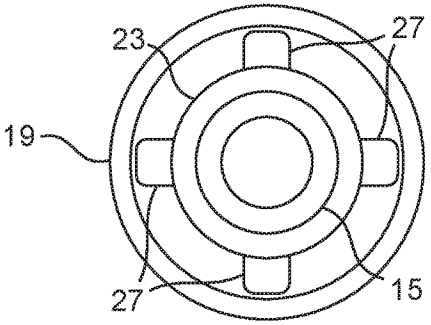
FIG. 7 shows a cross-section through the line B-B' of FIG. 4.
Figure 6:
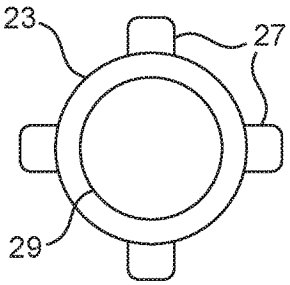
FIG. 6 shows an end view of the spin-through stator.
Figure 5:
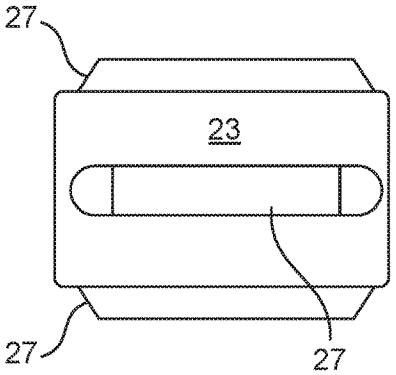
FIG. 5 shows a side view of the spin-through stator.

FIGS. 5 and 6 show the stator 23 in side view and end view, respectively. The stator 23 is usually constructed of a wear and chemical resistant plastic and is normally extruded, or molded, as one piece with a central bore 29, and three or more vanes 27 on its periphery. Referring to FIG. 7, a radial cross-section through the center of the connection (B-B' in FIG. 4), the inner diameter of the cylindrical central bore 29 through the stator 23 is slightly larger (a few thousandths of an inch) than the outside diameter of coupling 15 to allow relative rotation between the stator 23 and the coupling 15. When assembled, the finely finished internal surface of the central bore in the stator 23 acts as a bearing, and the finely finished outer surface 16 of coupling 15 acts as a bearing journal, so the connected rods 11 and 12 can turn smoothly within the stator 23.

The vanes 27 act to center the stator and, hence, the rod connection inside the tubing 19, while allowing fluid to flow past the connection. The outside diameter of the vanes 27 is slightly smaller than the inside diameter of the tubing 19 to allow ease of installation.

Figure 10:
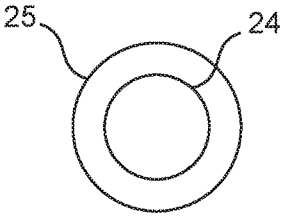
FIG. 10 shows an end view of the retaining washers.
Figure 9:
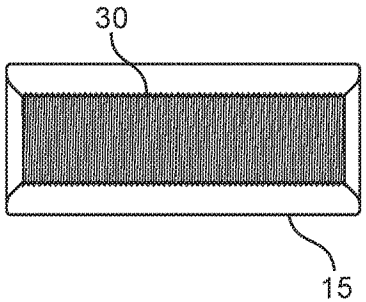
FIG. 9 shows an axial cross-section through a standard coupling.
Figure 8:
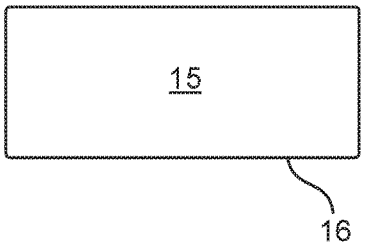
FIG. 8 shows a side view of a standard internally threaded female coupling.

FIG. 8 is side view of the coupling 15, and FIG. 9 is an axial cross-section view of coupling 15, showing the female threaded bore 30. FIG. 10 shows the washer 25 in front view. The outer diameter of the washer 25 is larger in outer diameter than that of coupling 15, and forms a lip that axially retains stator 23 when the connection is made up, as shown in FIG. 4. The bore 24 through the center of the washer 25 is slightly larger than the outer diameter of the threaded portion of the male threaded pins 21 and 22. Washer 26 is identical to washer 25.

The first embodiment of the present invention, shown in FIGS. 3 through 10, utilizes two washers, 25 and 26, situated between coupling 15 and the adjacent shoulders 17 and 18, to axially retain the stator 23 in its position over coupling 15. One of the advantages of this embodiment is a conventional rod connection can be easily converted to a spin-through stabilizer via a couple of washers 25, and 26, and a stator 23, while utilizing the same type of female coupling used in conventional rod connections. A potential disadvantage of this first embodiment, however, is in the disassembly of the rod connections.

Usually, a conventional rod connection is made without holding or rotating the female coupling—only the rods are rotated. The make-up procedure of the first embodiment, likewise, does not require manipulating coupling 15. However, when the rod string is pulled from the well and disassembled, the couplings will remain on one or the other of the formerly joined rod pins. The only way the coupling can be removed from that rod pin is by restraining the rod via the wrench flat (e.g. 13), and applying a pipe wrench to the external surface of the coupling to break the connection. The pipe wrench jaws can deeply mar the outer surface of the coupling. This surface damage would render the coupling unsuitable for reuse without refinishing.

Figure 12:
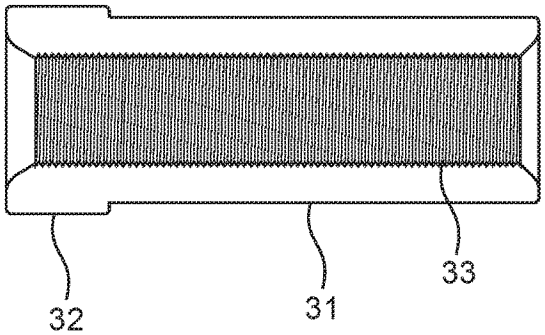
FIG. 12 shows an axial cross-section through FIG. 11 coupling.
Figure 11:
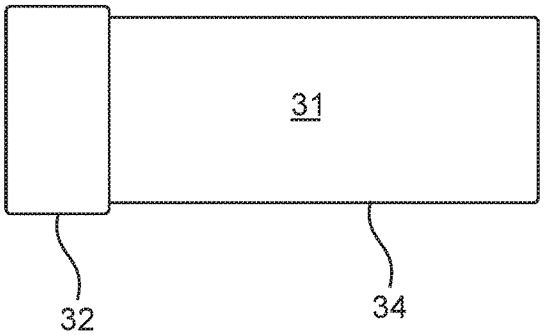
FIG. 11 shows a side view of an alternative internally threaded female coupling used in the second embodiment of the current invention.

A second embodiment of the present invention, which addresses this disassembly issue, is shown in FIGS. 11 through 16. The female coupling 31 of this alternative embodiment is shown in FIGS. 11 and 12. Unlike coupling 15 of the first embodiment, which has a constant outside diameter over its entire length, coupling 31 has a machined shoulder 32 that is larger in outside diameter than the main body 34 of coupling 31. This shoulder serves two purposes. First, it takes the place of one of the retaining washers, in this instance, washer 25, and, secondly, the larger diameter of the shoulder 32 provides a surface for a pipe wrench to grip while removing the coupling 31 from the rod pin during disassembly. The smooth bearing outer surface of the main body 34 of coupling 31 is therefore not touched by the wrench jaws during disassembly, so the coupling can be reused without requiring refinishing.

Figure 13:
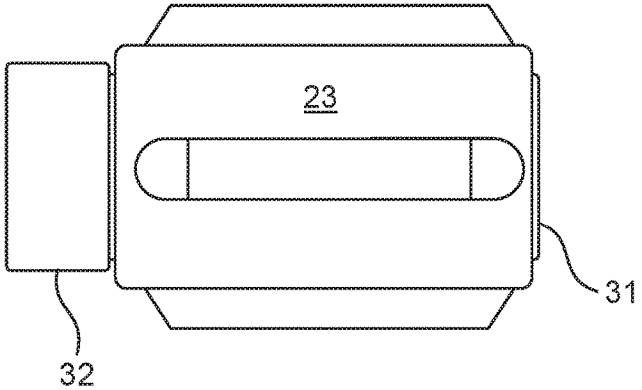
FIG. 13 shows a spin-through stator mounted on a coupling of the type shown in FIG. 11.
Figure 14:
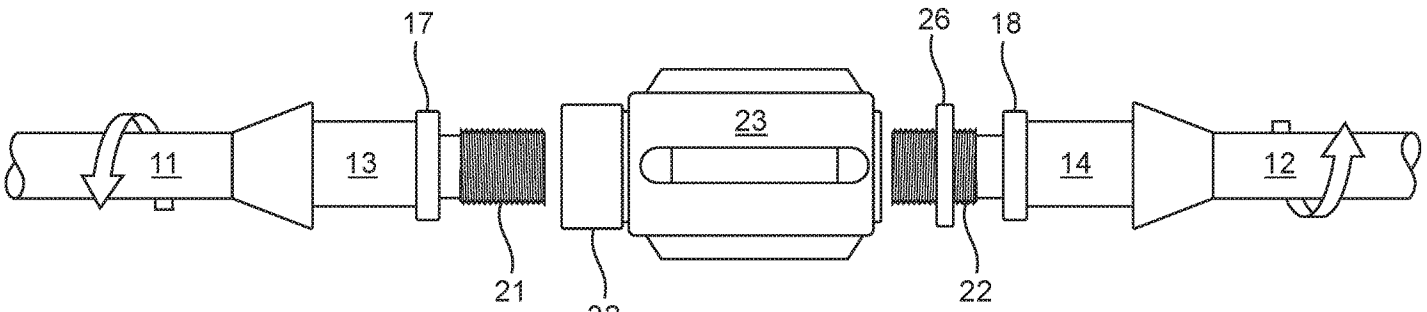
FIG. 14 shows the components of the second embodiment of the present invention, prior to rod connection make-up.
Figure 15:
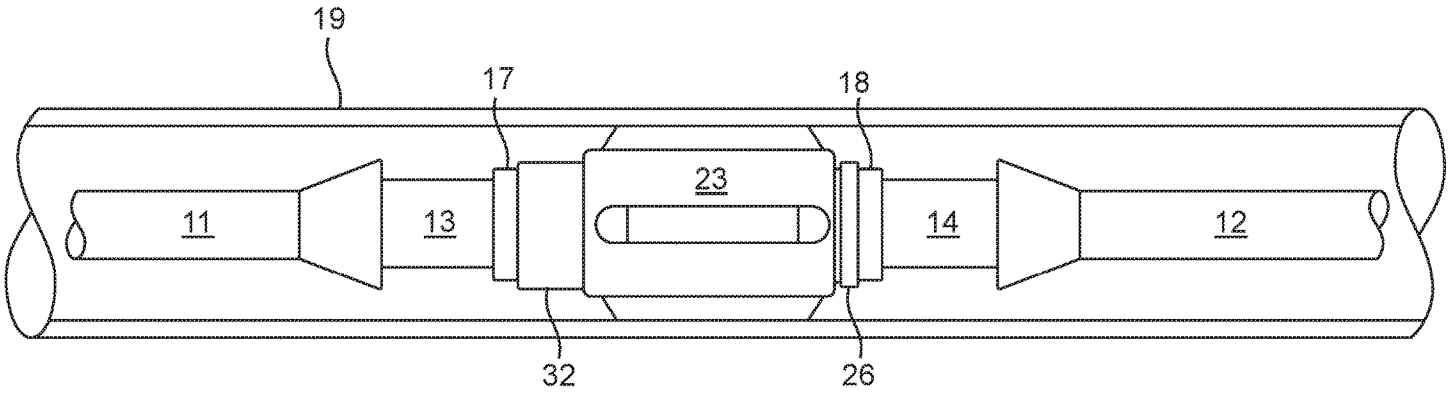
FIG. 15 shows a side view of the second embodiment of the present invention, with the connection made up, and within the production tubing.

FIG. 12 shows this modified coupling 31 in cross-section, showing the threaded internal bore, 33. FIG. 13 shows the stator 23 fitted over coupling 31, in preparation for rod connection, with shoulder 32 preventing stator 23 from moving axially to the left. FIG. 14 shows the components of this second embodiment during assembly and make-up. A stator 23 is fitted over coupling 31 prior to make-up, with washer 26 fitted over threaded pin 22. The connection is made up as it is for the first embodiment, with the male threaded pins 21 and 22 screwed into coupling 31. In this second embodiment, however, the connection with rod 11 is made up between rod shoulder 17 and coupling shoulder 32. The connection with rod 12 is made up as in the FIG. 4 embodiment, with washer 26 interposed between rod shoulder 18 and female coupling 31, with the stator 23 axially captured between them, as shown in FIG. 15. The external surface 34 of coupling 31 is machined to a smooth surface, with no indentations, embossed lettering, or other surface features that would interfere with contact between this outer surface and the inner surface of the bore 26 of stator 23.

Figure 17:
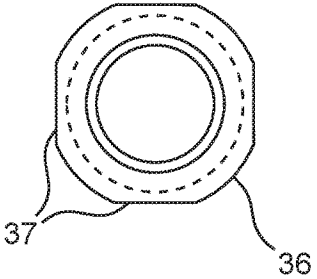
FIG. 17 shows an end view of the FIG. 16 threaded female coupling.
Figure 16:
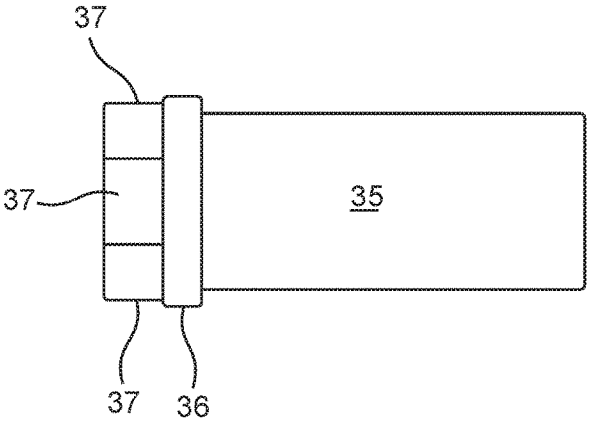
FIG. 16 shows an alternative configuration of the female threaded coupling of the second embodiment.
Figure 18:
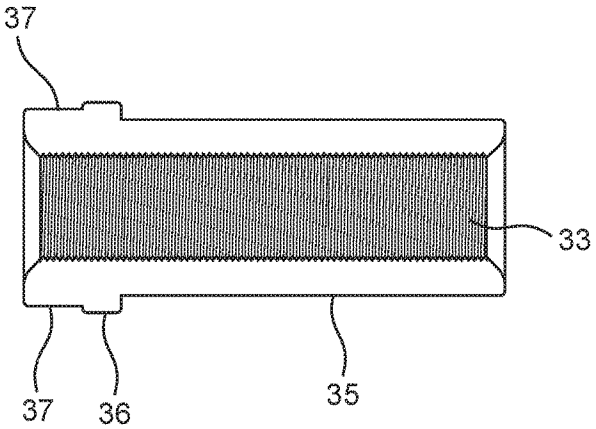
FIG. 18 shows an axial cross-section through the female threaded coupling of FIG. 16.

A minor modification of the threaded female coupling of the second embodiment is shown in FIGS. 16 through 18, where the shoulder 36 is fitted with machined wrench flats 37, allowing coupling 35 to be gripped with a conventional wrench, rather than a pipe wrench, for removal from the rods during disassembly.

It will be appreciated that those skilled in the art, upon reading this detailed description, may think of some variations in structure and form, such variations are within the contemplation of the invention as described and claimed in the following:

The invention claimed is:

1. A drive rod string centralizer to position a connection between a first rod string and a second rod string within a production tubing, the drive rod string centralizer comprising:

a stator, said stator being comprised of a cylindrical body having a longitudinal length, said cylindrical body having an external diameter less than the internal diameter of said production tubing, and having a smooth central bore and several, equal length vanes extending radially from said cylindrical body, the radial extent of said vanes being less than the internal diameter of said production tubing;

a cylindrical coupling, said cylindrical coupling having a central bore along its longitudinal length, said central bore being equipped with female threads on the interior surface, a first length of the outer cylindrical surface of said coupling having an external diameter less than then the internal diameter of the central bore of said stator, said first length being greater than the length of said stator, and a second length of the outer cylindrical surface having an external diameter greater than the internal diameter of said central bore of said stator, a thin circular disc, said thin circular disc having an outer diameter greater than the inner diameter of said central bore of said stator, and having a central bore;

wherein said central bore of said circular disc has an inner diameter greater than the outer diameter of threads of threaded pins on said ends of each of said first rod string and said second rod string;

wherein said first length of said coupling is inserted into said stator central bore;

wherein said first rod string and said second rod string are aligned axially with one another and with said coupling and stator, said circular disc being disposed between a shoulder of said first rod string or said second rod string and the end of said first length of said coupling;

wherein said rods are rotated in such a manner as to cause said threaded pins to thread into said coupling until said coupling and circular disc are firmly held between said shoulders.

2. The drive rod string centralizer of claim 1, wherein said second length of said cylindrical coupling has flat surfaces machined or formed into the outer surface of said second length of said cylindrical coupling tangentially to the longitudinal axis of said cylindrical coupling.

* * * * *